United States Patent [19]

Nartowski

[11] 4,439,377

[45] Mar. 27, 1984

[54] CARBURETOR FOR AN INTERNAL COMBUSTION MOTOR

[75] Inventor: André Nartowski, Marly le Roi, France

[73] Assignee: Regie Nationale des Usines Renault, Boulogne-Billancourt, France

[21] Appl. No.: 349,902

[22] Filed: Feb. 18, 1982

[30] Foreign Application Priority Data

Mar. 3, 1981 [FR] France ..... 81 04185

[51] Int. Cl.[3] ..... F02M 1/14

[52] U.S. Cl. ..... 261/52; 261/64 C; 261/64 E

[58] Field of Search ..... 261/64 E, 52, 64 B, 261/64 C

[56] References Cited

U.S. PATENT DOCUMENTS

| | | | |
|---|---|---|---|
| 3,190,623 | 6/1965 | Ball | 261/39 B |
| 3,837,322 | 9/1974 | Shishido et al. | 261/64 E |
| 3,906,911 | 9/1975 | Nakada et al. | 261/64 E |
| 3,928,511 | 12/1975 | Atsumi et al. | 261/64 C |
| 3,962,380 | 6/1976 | Cedar et al. | 261/52 |

FOREIGN PATENT DOCUMENTS

| | | | |
|---|---|---|---|
| 29789 | 3/1981 | European Pat. Off. | 261/51 |
| 2525594 | 12/1976 | Fed. Rep. of Germany | 261/52 |
| 348328 | 3/1937 | Italy | 261/52 |

*Primary Examiner*—Tim R. Miles

*Attorney, Agent, or Firm*—Oblon, Fisher, Spivak, McClelland & Maier

[57] ABSTRACT

The carburetor comprises a body provided with a fuel nozzle device, a choke valve and a butterfly rotatably mounted in the body respectively above and below the nozzle system. A spring pulls the choke valve into its fully closed position. A diaphragm sensitive to low pressure prevailing in the intake manifold of the engine is connected to a linkage forming a connection between the choke valve and the diaphragm. A manually operated cam includes a stop which is movable between an active position and a retracted position where it allows, during cold operation, the diaphragm and the linkage to pivot the choke valve between its minimum and maximum opening positions, according to the load on the engine.

4 Claims, 10 Drawing Figures

CARBURETOR FOR AN INTERNAL COMBUSTION MOTOR

BACKGROUND OF THE INVENTION

1. Field of the Invention

The present invention relates to a carburetor, with a choke including an air control valve, for an internal combustion motor.

2. Description of the Prior Art

In a large number of carburetors actually in use, the "choke" for cold starting is made up of a mechanism comprising a choke handle, and a choke valve rotatably mounted in the carburetor body above the fuel nozzle. When one pulls the choke handle, the choke valve completely closes and blocks air from entering the body of the carburetor. When the motor turns over, a diaphragm having one side connected to the intake manifold opens the choke valve halfway as a result of the low pressure then prevailing in the intake manifold due to the small butterfly gas valve opening. After starting the engine, the choke is partially closed as the engine runs cold. The effect of this is to place the choke valve in an intermediate, half open position between its closed and fully open positions.

Of course, fully or partially closing the air valve enriches the air-fuel mixture reaching the engine. This enrichment increases proportionally as the air valve is closed further.

As a result, automobiles equipped with such carburetors consume excess fuel when cold. This over-consumption is increasingly significant the colder the engine is. As shown in FIG. 9 of the attached drawings, curve A represents, as a function of distance travelled, the fuel consumption (in liters/100 km) of an engine after a cold start at an ambient temperature of −5° C., and curve C illustrates the fuel consumption of the same engine after a warm start.

However, statistical studies have shown that a large number of vehicles, notably in an urban setting, were used for daily trips of a few kilometers, i.e. in the least favorable section of Curve A. Substantial fuel savings could be realized if one were to reduce cold-running over-consumption of a large number of vehicles by equipping them with revised choke valve carburetors.

The French Pat. No. 2 393 161 describes a carburetor which helps solve this problem. This carburetor is of the type consisting of a body provided with a fuel nozzle, a choke valve rotatably mounted in the body above a fuel nozzle device, a butterfly valve which controls the engine load, rotatably mounted in the body below the fuel nozzle device, a spring that pulls the air valve back into its fully closed position, a valve activating device that is sensitive to the low pressure prevailing in the intake manifold and a connecting linkage between the low pressure sensitive device and the choke valve, the linkage having at least one articulation. The low pressure sensitive activating device is disposed so as to allow the choke valve to pivot between its fully closed position and a position of maximum opening against the spring force. A manually operated cam is rotatably mounted between a first position, corresponding to cold starting, where it interacts with the linkage to limit the opening movement of the choke valve to a partial open position, a second position, corresponding to cold running, where it allows the choke valve to pivot between a minimum opening position and said maximum opening position and a third position where it holds the choke valve in a fully open position.

However, the structure of this carburetor is relatively complex and it is costly to produce because it consists of a large number of different interrelating moving parts. The present invention contemplates a carburetor of the above type whose construction is particularly simple.

SUMMARY OF THE INVENTION

Therefore, the object of the invention is a carburetor of the abovementioned type in which the cam has an appendage which, in the first position of the cam, is interposed in the displacement path of the articulation and which, in the second position of the cam is outside the displacement path of the articulation. Thus, in the second cam position the low pressure sensitive activation device may move the valve between the minimum and maximum opening positions. This is accomplished by means of a minimum number of modifications in comparison to a conventional carburetor such as that described above.

According to an embodiment of the carburetor, the cam has a first surface which interacts with the articulation to fix the minimum opening position of the choke valve in the second cam position and to fix the fully open position of the choke valve in the third cam position, and a second surface coupled to the appendage and interacting with the articulation to fix the partial open position of the valve in the first cam position.

According to another feature, the linkage is composed of a tie rod connected respectively to a moving diaphragm of the low pressure sensitive device and, by the articulation, to a lever which is solidly attached to, and turns with, the choke valve.

The maximum opening position is the position of total choke valve opening.

BRIEF DESCRIPTION OF THE DRAWINGS

Other characteristics and advantages of the invention will be evident from the following description of an embodiment given only by way of example and illustrated in the attached drawings wherein.

DETAILED DESCRIPTION OF THE PREFERRED EMBODIMENTS

Figure 1:
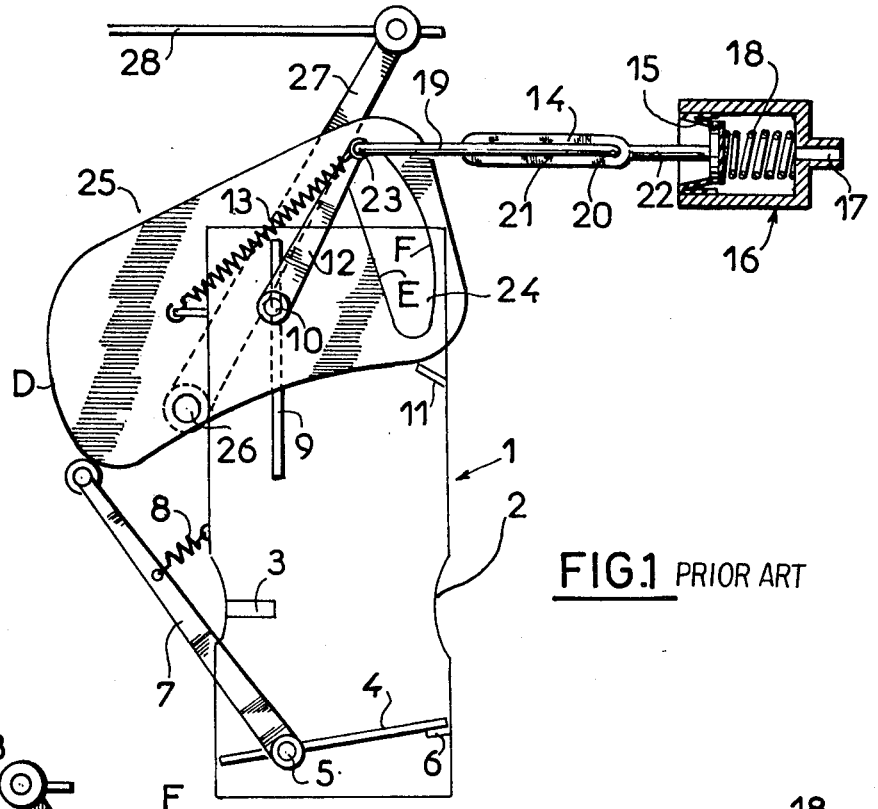
FIG.1 PRIOR ART
FIG. 1 is a schematic view of the choke valve mechanism of a conventional carburetor, showing said mechanism in the disengaged position of the choke.

FIG. 1 shows schematically the known choke valve mechanism of a carburetor. The carburetor body 1 comprises a venturi tube or barrel 2 in which is mounted a fuel nozzle device 3. Below the venturi tube 2, a fuel butterfly valve 4 is rotatably mounted around an eccentric axis 5 between a fully closed position limited by a stop 6 and a fully open position. The rotation of the butterfly valve 4 is controlled by a lever 7 to which a spring 8 is attached, which biases the butterfly valve 4 into its closed position.

A choke air control valve 9 for cold starting is also rotatably mounted on an eccentric axis 10 in the body 1, and above the venturi tube 2. This valve may pivot between a fully closed position limited by a stop 11 and a fully open position, shown in FIG. 1. The axis is attached at one extremity to a lever 12 which controls the movements of the choke valve 9 between its open and closed positions. A spring 13, attached to the lever 12, biases the choke valve 9 into its closed position.

The other extremity of the lever 12 is connected by a linkage 14 to the diaphragm 15 of a vacuum housing 16 whose interior volume communicates by way of a channel 17 with that of the intake manifold (FIG. 10) of the engine (also not shown) upon which the carburetor is mounted. When a low pressure prevails in the intake manifold, the diaphragm 15 is pulled toward the interior of the housing against a spring 18.

The linkage 14 consists of a first tie rod 19 articulated at one extremity to the lever 12, and whose other extremity 20 is slidingly held in a buttonhole slot 21 of a second tie rod 22 which is connected to and moves with the diaphragm 15.

The articulation axis 23 of the lever 12 with the tie rod 19 is guided in an opening 24 of a cam 25, which is articulated around an axis 26 parallel to axes 5, 10 and 22. The rotation movements of the cam 25 around its axis 26 are controlled by a lever 27 which is solidly attached to the axis 26, and a manually operated choke linkage 28. A part of the exterior shape of the cam 25 consists of a first cam surface D with which the free extremity of the lever 7 interacts, while the opposing edges of the opening 24 define two other cam surfaces E and F which interact with the extremity of lever 12.

Figure 2:
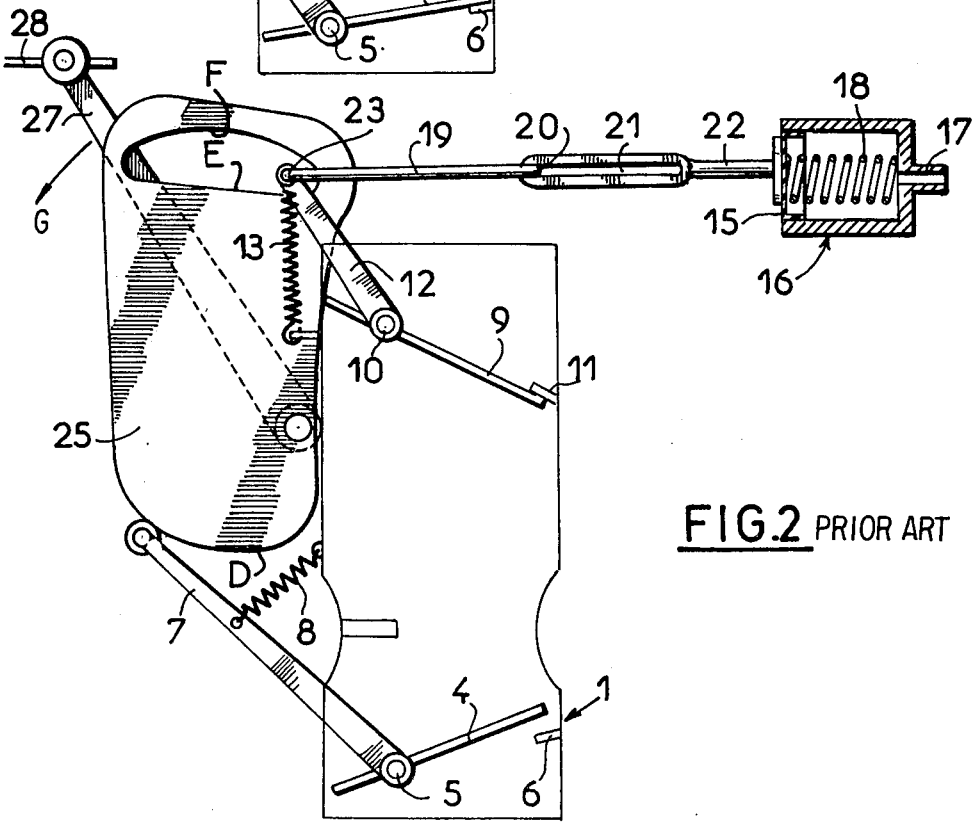
FIG.2 PRIOR ART
FIG. 2 is a view analogous to FIG. 1 showing the mechanism in the position which precedes cold starting, the choke handle being fully pulled out.

In the following description of the function of the device as described above, the assumption is made that the device is installed on an automobile engine, however this is in no way intended to limit the invention to such an application. Before starting a cold engine, the vehicle being at rest, the choke handle is normally in its disengaged or pushed in position, which corresponds to the position in FIG. 1. Thus, the butterfly 4 is fully closed and the choke valve 9 is completely open. Before the engine is started the choke handle is first pulled. This moves the linkage 28 from the position in FIG. 1 to that in FIG. 2. The result is a rotation of lever 27 in the direction of arrow G, and a simultaneous rotation through the same angle of cam 25 which moves to the position in FIG. 2. During this rotation, the extremity 23 of lever 12 follows the cam surface E under the effect of the pull exerted by spring 13 until the choke valve 9 reaches the closed position limited by the stop 11. When valve 9 comes to rest on stop 11 it may stop moving before the cam ends its rotation movement, as shown in FIG. 2. The extremity 23 of the lever thus may be at a slight distance from the cam surface E. The length of the tie rods 19 and 22 and the buttonhole slot 21 are such that in this position, the diaphragm 15 is completely pushed out by the spring 18. The extremity 20 of the tie rod 19 rests against the base of the buttonhole slot 21, on one side of the free extremity of the tie rod 22. Simultaneously, during the rotation of cam 25, the surface D of the cam progressively pushes the lever 7 to partly open the gas butterfly valve 4 to the position shown in FIG. 2.

Figure 3:
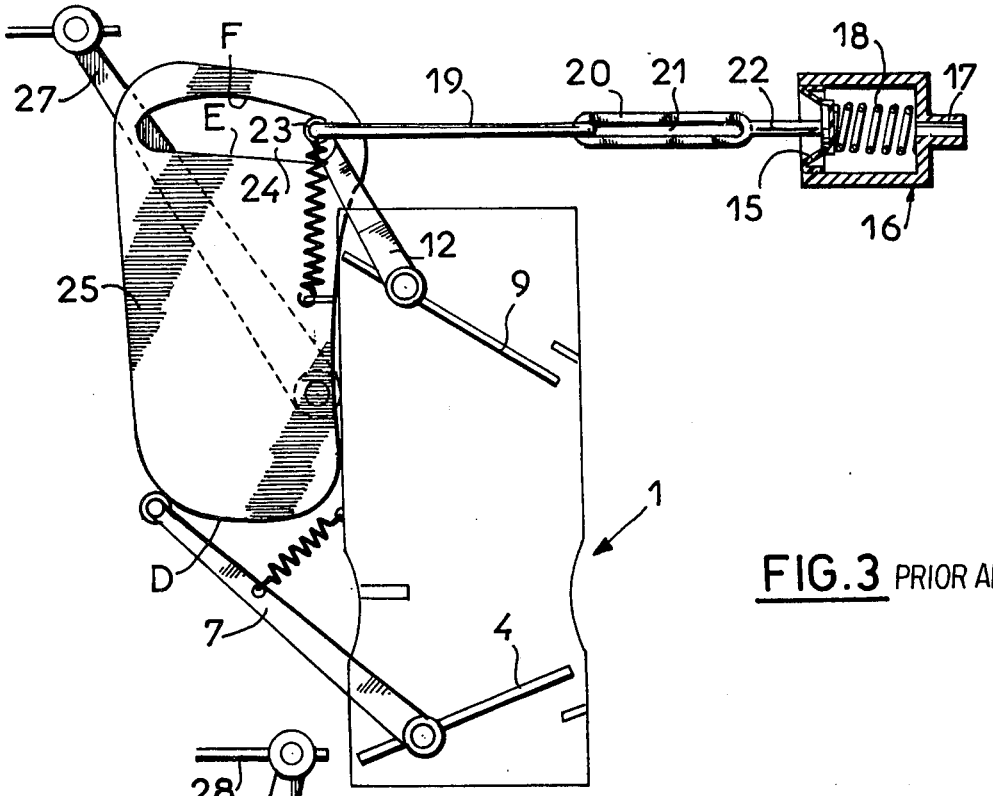
FIG. 3 PRIOR ART
FIG. 3 shows the mechanism in the same position as in FIG. 2, but immediately after the engine has started.

Once the engine has started, a low pressure is created in the intake manifold, below the butterfly 4, due to the fact that it is slightly open. This low pressure is also applied to the diaphragm housing 16 through the conduit 17 and pulls the diaphragm 15 against the spring 18. The displacement of the diaphragm 15 draws the articulation 23 of the tie rod 19 with the lever 12 until this articulation comes into contact with the cam surface F of the opening 24, as shown in FIG. 3. This moves the choke valve 9 to a half open position which assures a slight leanness in the air/fuel mixture starting as soon as the engine is started, thus keeping it from choking out immediately. Of course, in this position, which corresponds to fast idle, the position of the cam 25 does not change; the choke is always pulled all the way out.

As soon as the engine has been run long enough after starting, the first choke adjustment is made. This brings cam 25 into the position shown in FIG. 4. As the cam 25 rotates, the cam surface E pushes the articulation 23 and turns the lever 12 and the choke valve 9 to the partially open position of FIG. 4. Therefore, the fuel/air mixture furnished by the carburetor is leaner than in the case of fast idling in FIG. 3. This is perceivably richer than in the completely open choke valve position. The rotation of cam 25 also has the effect of allowing the butterfly valve to close due to the shape of cam surface D.

Figure 4:
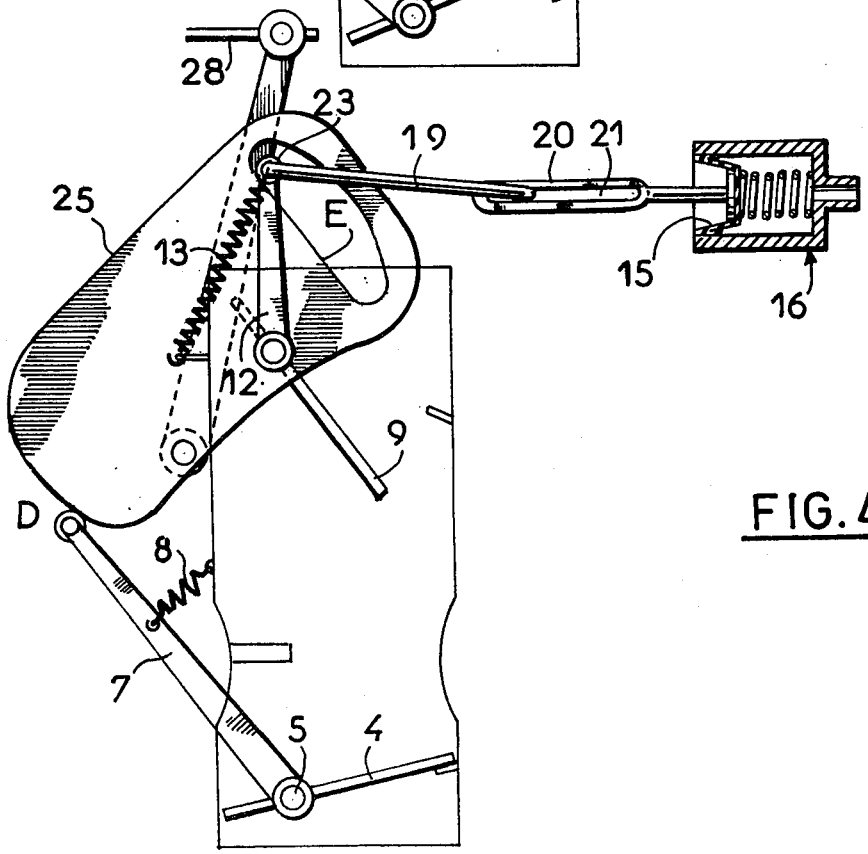
FIG. 4 PRIOR ART
FIG. 4 shows the mechanism in FIGS. 1 to 3 in the partially pushed in choke position.

It can be seen that in the position shown in FIG. 4, the diaphragm is pulled completely into housing 16 under the effect of the low pressure caused by the closing of the butterfly valve. In the meantime the displacement of the diaphragm has no additional influence on that of the articulation 23 and choke valve 9 because the end 20 of the tie rod 19 moves in the buttonhole slot 21. In other words, beginning at this instant, the carburetor provides the engine a relatively richer mixture regardless of the operating range of the engine (for instance slow, acceleration, deceleration or steady speed). This richness cannot be diminished without manually deactivating the choke in response to the heating of the engine. When the engine has reached normal operating temperature, the choke handle may, in principle, be pushed back in and the choke valve 9 will be opened wide as shown in FIG. 1.

In reference now to FIGS. 5 to 8 there will be shown the choke mechanism according to the invention in different positions corresponding respectively to those of FIGS. 1 through 4 and in which the same numerical references are used, starting with the number 100, to designate analogous elements.

This mechanism differs from the known mechanism previously described essentially in the shape of the cam and the embodiment of the linkage of the diaphragm assembly. More precisely, the cam 125 has an exterior shape whose first portion comprises a cam surface D' which interacts with the extremity of lever 107 and plays the same role as cam surface D, namely to partially open the butterfly valve 104 when the choke is pulled out. However, in contrast to cam 25, cam 125 does not have an opening but has an appendage 130 in the form of a hook whose interior contour forms a cam surface F' which is an extension of another cam surface E'. This cam surface E' plays the same role as the cam surface E and is defined by a second portion of the exterior contour of cam 125. On the other hand, the linkage 114 is a simple push rod articulated to the lever 112 at 123 and to the diaphragm 115 of housing 116. As the description will show, the length of the tie rod and the movement of the diaphragm 115 are adapted to allow the valve 109 to pivot between its fully closed position and its fully open position.

Figure 5:
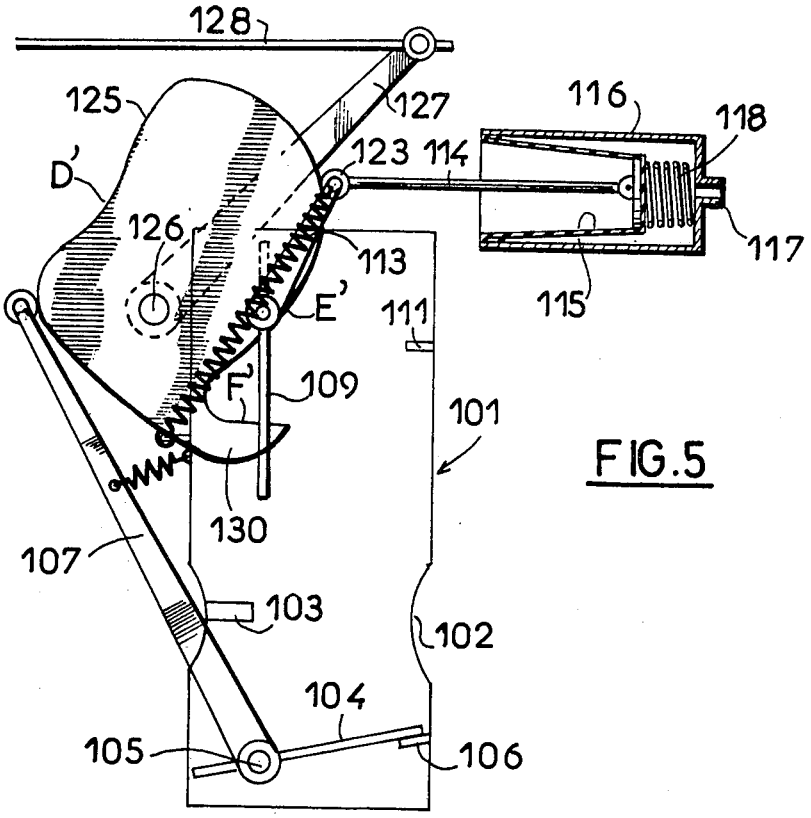
FIG. 5 is a schematic view of a choke valve mechanism according to the invention shown in a position equivalent to that in FIG. 1.

FIG. 5 shows the mechanism in the position where the choke handle is pushed all the way in. In this position the mechanism according to the invention plays exactly the same role as that in FIG. 1, the cam surface E' keeps the valve 109 in its fully open position.

Figure 6:
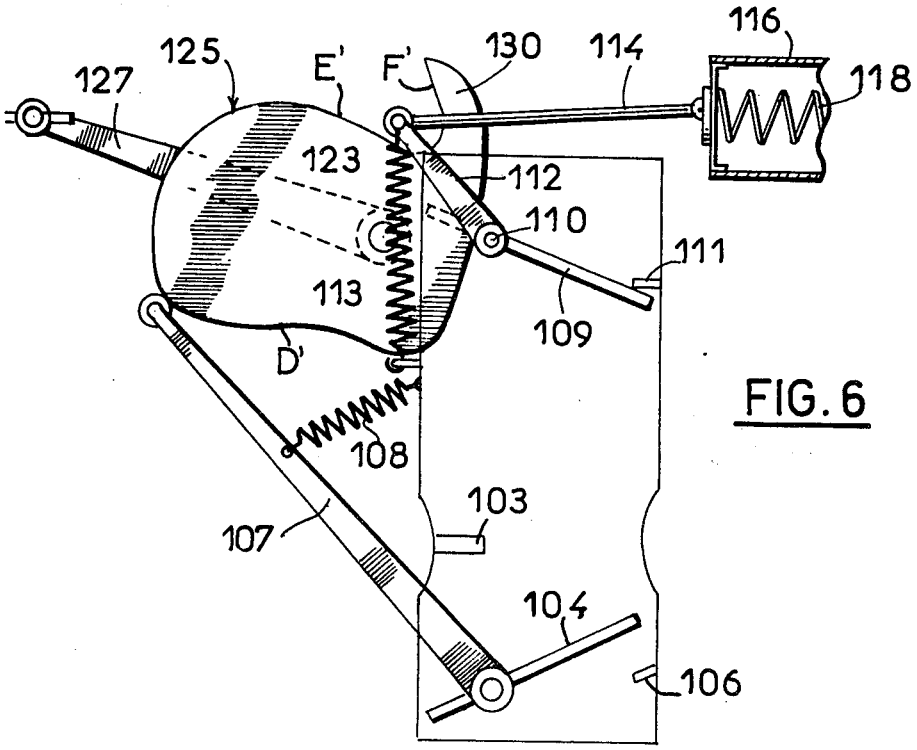
FIG. 6 is a view of the mechanism in FIG. 5 shown in a position equivalent to that in FIG. 2.

When the choke handle is pulled out, just before the engine is started, the mechanism assumes the position shown in FIG. 6. The valve 109 is thus fully closed by the force exerted by the spring 113, while the butterfly valve 104 is partially opened by the interaction between the cam surface D' and the lever 107.

Figure 7:
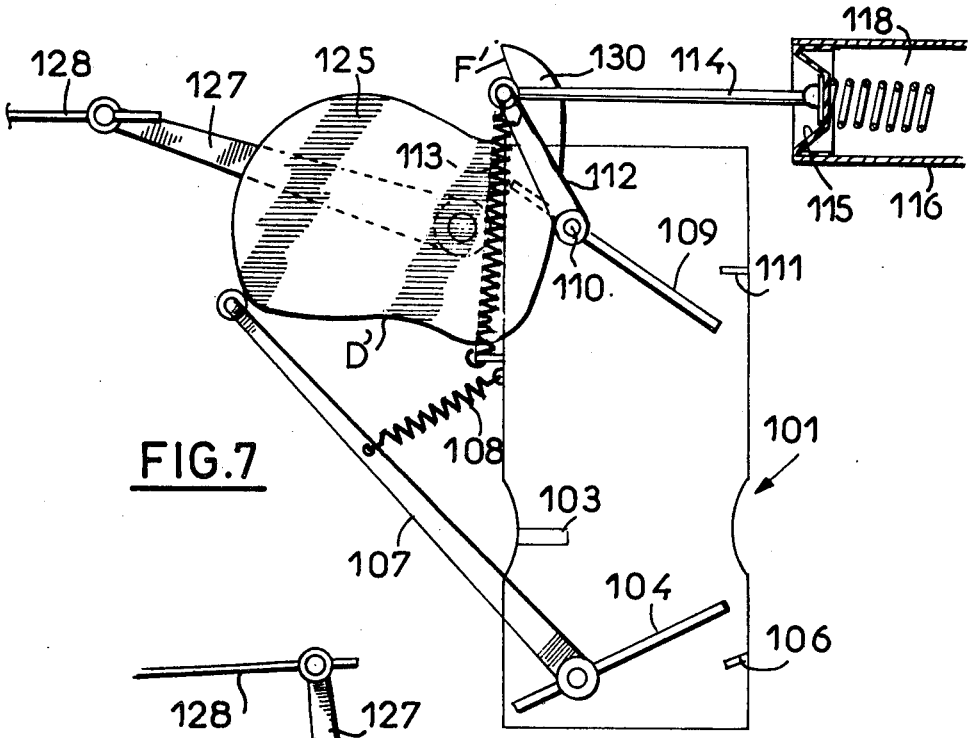
FIG. 7 is a view of the mechanism in FIGS. 5 and 6 shown in a position equivalent to that in FIG. 3.

When the engine is started, the low pressure in the intake manifold is applied to the diaphragm housing 116 and the diaphragm 115 forces the articulation 123 against the cam surface F'. The valve 109 thus takes a partial open position as shown in FIG. 7. At this stage the operation of the mechanism according to the invention is identical to that of the known mechanism.

Figure 8:
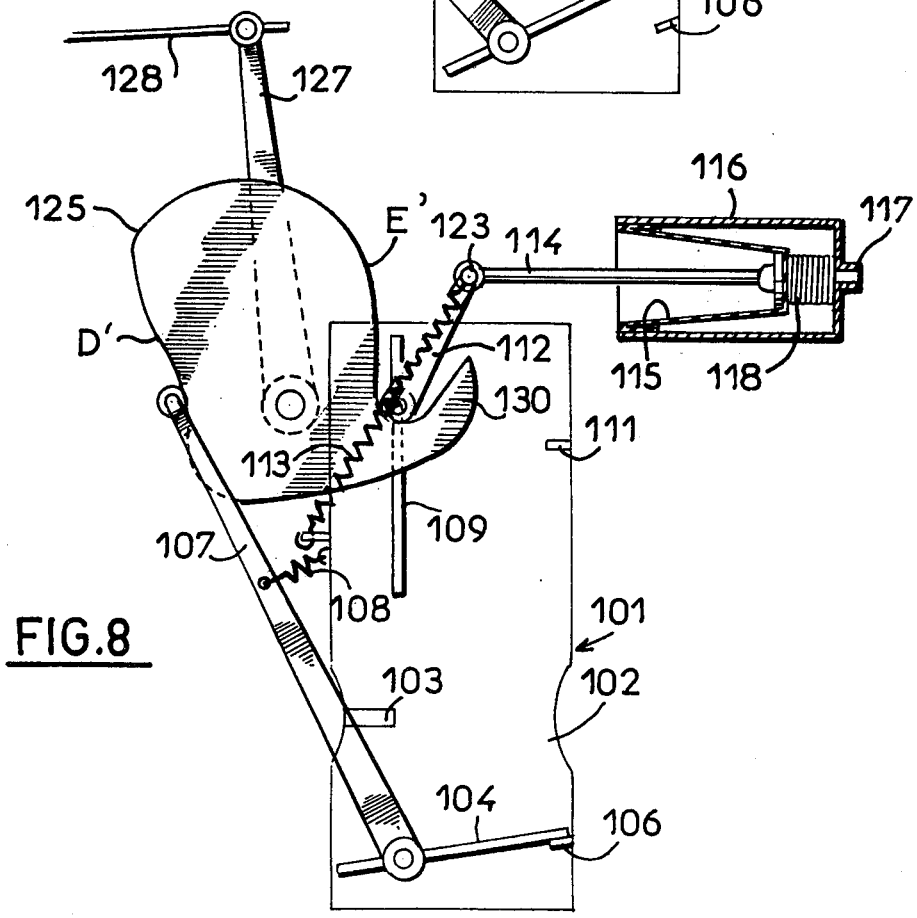
FIG. 8 is a view of the mechanism in FIGS. 5 to 7 shown in a position equivalent to that in FIG. 4.

When the choke is first partially pushed in, the appendage 130, which acts as a stop, is retracted by the rotation of the cam 125, as shown in FIG. 8; in effect, in this position of the cam 125, the lever 112 is free to pivot between the fully open position of the choke valve in FIG. 8 and a minimum open position limited by the articulation 123 coming to rest against the cam surface E'.

Consequently, the position of the choke valve 109, and thus the richness of the mixture, does not depend solely on the position of the choke, but also on the operation conditions of the engine. Thus, during idle, deceleration or constant speed, the low pressure in the intake manifold is strong because the opening of the butterfly is small. As shown in FIG. 8, the diaphragm 115 exhibits, therefore, maximum displacement and complete opening of the choke valve 109. The engine, even when cold, operates with a lean mixture identical to that which is provided when it is warm. In contrast, when accelerating or climbing a hill the butterfly is opened wide, the low pressure in the intake manifold falls off rapidly and the springs 113 and 118, which have the proper spring forces, immediately push the valve 109 into its partially open position imposed by cam surface E' which corresponds to that in FIG. 4. Thus, one again has the rich conditions of a known carburetor allowing the cold engine to once again respond to a heavy work load.

Figures 9, 10:
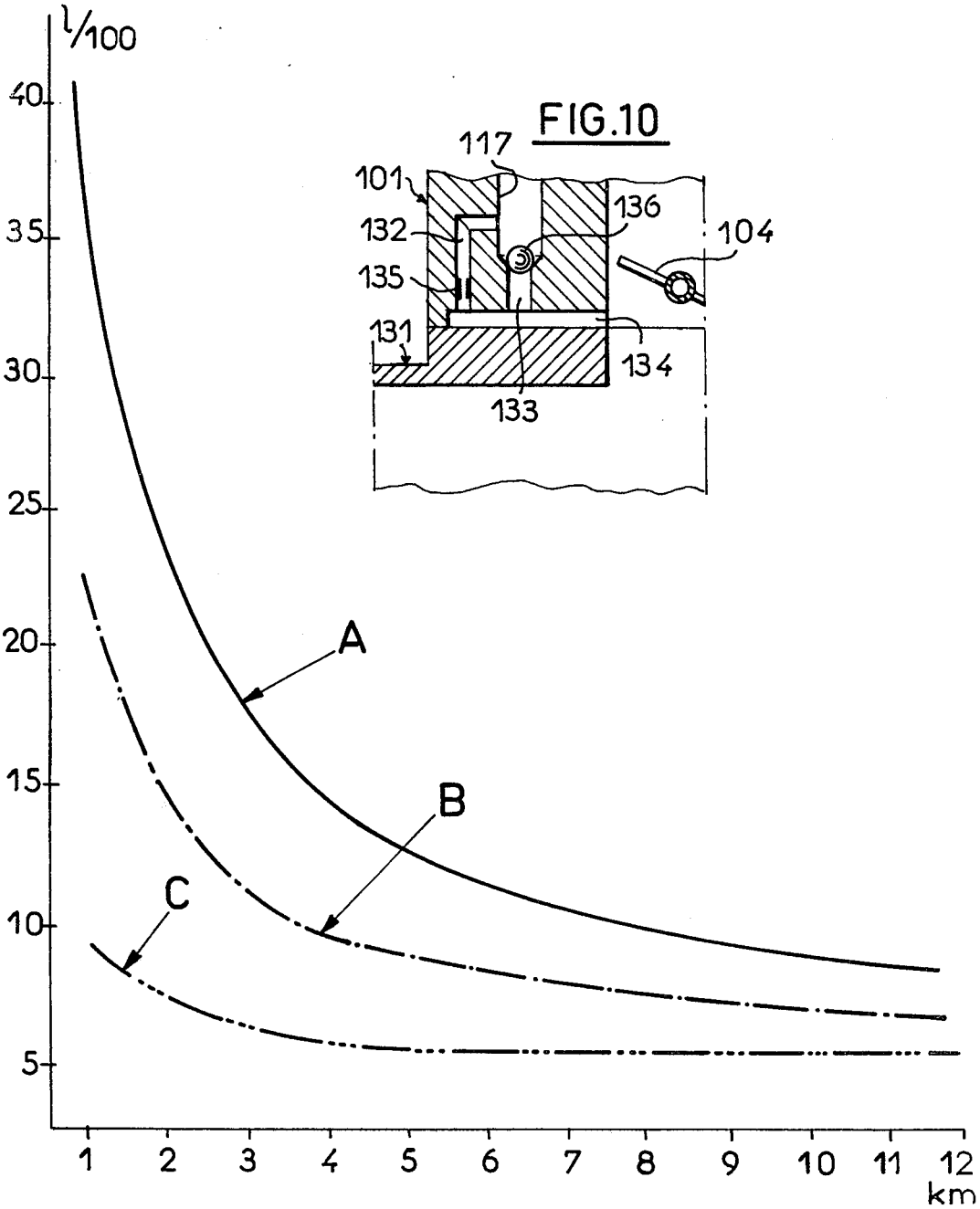
FIG. 9 is a graph showing the fuel consumption versus distance travelled curve A of a cold running engine with a conventional carburetor, fuel consumption curve B of the same engine equipped with a carburetor with a cold starting mechanism according to the invention and curve C of the same engine after warm starting.
FIG. 10 is a view in partial section of an embodiment of the valving which applies the low pressure of the intake manifold of the low pressure diaphragm.

Contrary to the known mechanism in which the diaphragm has no further effect once the choke handle is pushed partially in, the diaphragm 115 of the mechanism according to the invention continues to adjust the richness of the mixture to the engine load until the choke handle has been pushed in all the way. The mechanism according to the invention thus makes it possible to achieve good fuel economy by making the mixture leaner under all conditions where the cold engine functions under a light load. FIG. 9, which shows the fuel consumption curves in liters/100 km as a function of the distance traveled after starting, illustrates the economy that is realized; in effect, the fuel consumption curve B of an engine equipped with a carburetor improved according to the invention, after starting cold, shows considerably less fuel consumption than does the same engine functioning under the same conditions but with a known carburetor (A).

Statistical studies have shown that a large number of vehicles are used each day only for one or a few trips of a few kilometers. Under these conditions the fuel economy of the carburetor according to the invention is approximately 40% higher than that of a known carburetor.

Reference is now made to FIG. 10 which shows a partial section of a particular embodiment of the body 101 of the carburetor according to the invention, and the intake manifold 131. In this example the channel 117 opens into two parallel conduits 132 and 133 which then lead to a single conduit 134 which communicates with the interior volume of the intake manifold 131. Conduit 132 has a calibration 135 as well as a one way ball valve 136 which is interposed between the channel 117 and the conduit 133.

In operation, at the moment when the butterfly 104 opens, the low pressure in the intake manifold 131 is momentarily decreased. The prevailing low pressure in the housing 116 thus opens the valve 136 which then allows the low pressure to decrease very rapidly to the level of that in housing 116. As a consequence, choke valve 109 closes very rapidly, causing immediate enrichment of the mixture to compensate for the demands of acceleration.

In contrast, when the low pressure in the intake manifold 131 is intensified, the application of this low pressure to the housing 116 is retarded by the calibration 135 in such a manner that rapid opening of choke valve 109 is slowed, thus assuring the progressively leaner mixture.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A carburetor comprising:

at least one body defining a barrel extending between the atmosphere and an intake manifold, whereby air can flow through said barrel into said manifold;

a fuel nozzle extending into said barrel;

a choke valve rotatably mounted in said barrel upstream from said nozzle;

a butterfly valve rotatably mounted in said barrel downstream from said nozzle;

means for biasing said choke valve into a first position wherein said choke valve is completely closed;

pressure sensitive means movable in response to variations in the pressure in said intake manifold;

linkage means connected between said choke valve and said pressure sensitive means, said linkage means including at least one articulation and being movable by said pressure sensitive means to permit said choke valve to move between said first position and a second fully open position;

a cam rotatably mounted on said at least one body, said cam including an appendage fixed thereto; and means for moving said cam between first, second and third positions, wherein said appendage is in a displacement path of said at least one articulation when said cam is in said first position and wherein said appendage is outside of said displacement path when said cam is in said second position, whereby said appendage limits the opening of said choke valve only when said cam is in said first position.

2. A carburetor comprising:

at least one body defining a barrel extending between the atmosphere and an intake manifold, whereby air can flow through said barrel into said manifold;

a fuel nozzle extending into said barrel;

a choke valve rotatably mounted in said barrel upstream from said nozzle;

a butterfly valve rotatably mounted in said barrel downstream from said nozzle;

means for biasing said choke valve into a first position wherein said choke valve is completely closed;

pressure sensitive means movable in response to variations in the pressure in said intake manifold;

linkage means connected between said choke valve and said pressure sensitive means, said linkage means including at least one articulation and being movable by said pressure sensitive means to permit said choke valve to move between said first position and a second fully open position;

a cam rotatably mounted on said at least one body, said cam including an appendage; and means for moving said cam between first, second and third positions, wherein said appendage is in a displacement path of said at least one articulation when said cam is in said first position and wherein said appendage is outside of said displacement path when said cam is in said second position, whereby said appendage limits the opening of said choke valve only when said cam is in said first position, wherein said cam includes a first surface in said displacement path when said cam is in said second and third positions, whereby said first surface limits the closing of said choke valve when said cam is in said second and third positions.

3. The carburetor of claims 1 or 2 wherein said pressure sensitive means comprises a diaphragm having one side subject to the pressure in said intake manifold, and wherein said linkage comprises a rod connected to said diaphragm and a lever fixed to said choke valve and articulated to said rod at said at least one articulation.

4. The carburetor of claims 1 or 2 wherein said pressure sensitive means is arranged such that said choke valve is moved towards said second position as the pressure in said intake manifold decreases.

* * * * *